United States Patent [19]

Mitchell et al.

[11] 4,223,815

[45] Sep. 23, 1980

[54] POST FORM STAY INSERTER FOR SHIRT COLLARS

[75] Inventors: William O. Mitchell; Walter W. Frost; C. Ray Hamilton, all of Vidalia, Ga.

[73] Assignee: Oxford Industries, Inc., Vidalia, Ga.

[21] Appl. No.: 945,214

[22] Filed: Sep. 25, 1978

[51] Int. Cl.[2] ..... A41D 27/18; A41H 33/00; A41H 43/00

[52] U.S. Cl. ..... 223/2

[58] Field of Search ..... 223/2

[56] References Cited

U.S. PATENT DOCUMENTS

| | | | |
|---|---|---|---|
| 2,723,061 | 11/1955 | Liebowitz | 223/2 |
| 2,875,928 | 3/1959 | Cohen | 223/2 |
| 3,191,557 | 6/1965 | Moore | 223/2 X |

*Primary Examiner*—Louis Rimrodt

*Attorney, Agent, or Firm*—Jones, Thomas & Askew

[57] ABSTRACT

As a strip of material is intermittently moved along its length from a reel, it is heated so as to remove its curl, it is cut into segments in the form of collar stays, and adhesive is applied to one surface of the collar stay segments. The individual collar stays are then moved laterally into alignment with spaced collar template elements, and then moved into overlying relationship with the pointed portions of the collar template elements, and a worker manually inserts a partially completed collar structure about the template elements. The worker presses the collar material against the adhesive on the collar stay and lifts both the collar and the collar stays from the templates, with the adhesive carrying the collar stays with the collar material. The collar stays are subsequently sewn into the collar with top stitching about the edge of the collar structure.

6 Claims, 12 Drawing Figures

Fig. 2
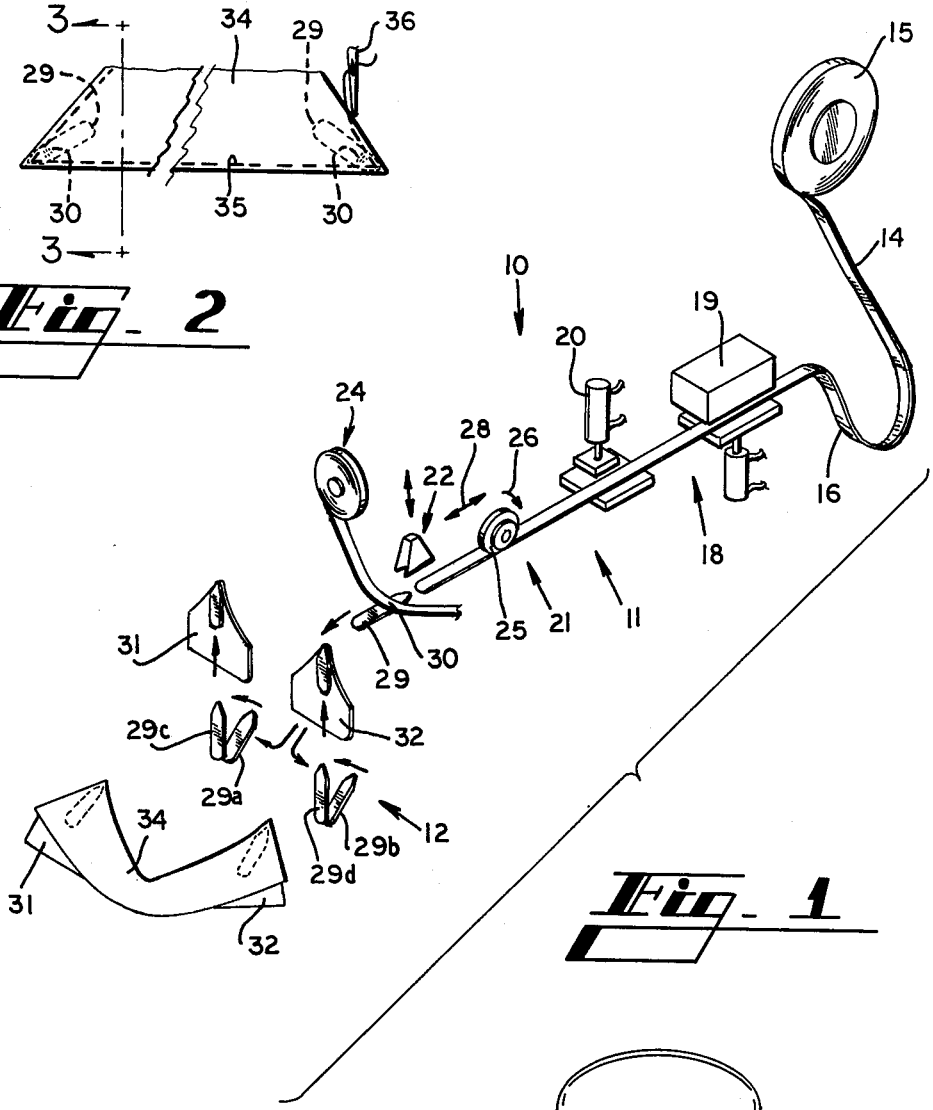
Fig. 1
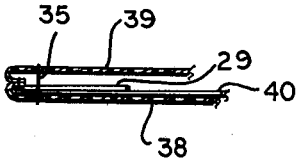
Fig. 3
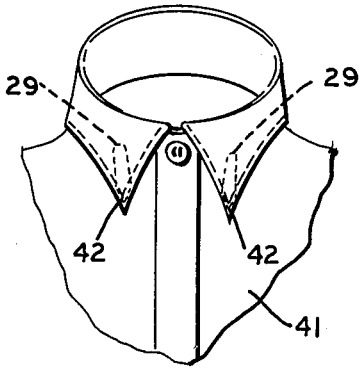
Fig. 4

POST FORM STAY INSERTER FOR SHIRT COLLARS

DESCRIPTION

Technical Field

This invention relates to a system which automatically and continually forms and positions collar stays at a collar template structure with adhesive applied to the collar stays, and relates to a method in which the worker inserts a partially completed shirt collar about the collar template structure and withdraws both the collar and collar stays from the template structure with the collar stays properly positioned and held by the adhesive in the collar structure. Top stitching is formed about the collar after the stays have been inserted. The shirt structure is thereby formed with its collar stays sewn into the structure by the top stitching of the shirt collar and with adhesive.

Background

In order to fabricate shirt collars from soft materials and yet have the collars formed so that they are attractive, it has become common for manufactures to insert collar stays into the collar structure so that the collar stays extend down into the pointed portions of the collar. The collar stays are usually semi-rigid flat strips of material with one pointed end portion inserted into the pointed part of a collar and with its other end being rounded so as to be comfortable to the wearer and so it will not harm the appearance of the collar. In some of the more expensive shirts, pockets are sewn into the underside of the collar structure to accommodate the collar stays. In other usually less expensive shirts the collar stays are sewn to the liner or to "quarter patches" which occupy the pointed portions of a collar. In some other structures the collar stays are completely omitted and the quarter patch material is relied upon to function as a collar stay.

In most of the prior shirt collar art, the collar stays are attached to the quarter patch or liner prior to the attachment of the quarter patch or liner to the rest of the collar structure. The worker usually sews or otherwise attaches a collar stay to the material, then attaches the material to the other plies of collar material, and then the product is everted and placed on a template where it is stretched, formed and pressed. During the everting, stretching and forming procedures the worker must be careful not to damage the collar, as by causing the pointed portion of the collar stay to break through the material, or by bending the collar stay, etc. In some instances the collar stay is improperly attached to the liner or quarter patch, and therefore is improperly positioned inside the finished collar structure. For example, the collar stays might be placed at the wrong angle in the collar structure or the collar stay may protrude too deeply or not deep enough into the pointed portions of the collar structure. Of course, when collar stays are present in the collar structure, more time is required by the worker to evert, form and press the collar structure. Moreover, an inventory of collar stays must be maintained and occasionally replenished by the worker that attaches the collar stays to the collar structure and when different style collars are being handled by the worker, it is sometimes necessary to change the length of the collar stays being inserted into the collar structure, which requires a new inventory of collar stays.

SUMMARY OF THE INVENTION

Briefly described, the present invention comprises a system for automatically and continually cutting collar stays from collar stay material and for placing the collar stays in overlying relationship with respect to a collar template structure. The apparatus disclosed herein removes the collar stay material from a reel, heats the collar stay material to reduce the residual curl in the material, intermittently moves the material along its length through a path where it passes through a cutter that cuts the material into collar stay segments, and applies adhesive to one surface of the collar stay segments. The apparatus further includes a means for loading the collar stays into overlying relationship with respect to the pointed portions of a pair of collar template elements. The operator merely inserts an everted, partially completed collar structure about the collar template elements, presses the collar material against the collar stays so that the adhesive causes the collar stays to adhere to the inside surface of the collar, and removes the collar with its collar stays properly inserted. The collar structure is then passed to a sewing station where the operator forms a top stitch about the edge of the collar structure, and the stitching in the collar passes through the collar stays to permanently anchor the collar stays in their proper positions within the collar structure. The collar is ultimately attached to a shirt, and the residual curvature of the collar stays tends to form the collar with an attractive convex appearance.

Thus, it is an object of this invention to provide an expedient, inexpensive, automatic and accurate system for placing collar stays in shirt collar structures.

Another object of this invention is to provide an improved shirt collar with its collar stays anchored therein by the top stitching about the edge of the collar and by adhesive clinging between the collar stay and the inner surfaces of the plies of collar material.

Another object of this invention is to provide a method of rapidly placing collar stays in shirt collars and the like, wherein the operator is able to cause collar stays to be automatically placed on a collar template structure, and the operator inserts a partially completed collar structure about the template whereby when the collar structure is withdrawn from the template the collar stays are fastened in the collar.

Other objects, features and advantages of the present invention will become apparent upon reading the following specification, when taken in conjunction with the accompanying drawings.

BRIEF DESCRIPTION OF THE DRAWINGS

FIG. 1 is a schematic illustration of the system of forming the collar stay segments and inserting the collar stay segments on the template structure, and of the procedure where the partially completed collar structure is inserted about the template structure and collar stays.

FIG. 2 is a plan view of a partially completed collar structure with the collar stays inserted therein, illustrating the manner in which the top stitching is applied to the collar structure.

FIG. 3 is a cross sectional illustration of the collar structure, taken along lines 3—3 of FIG. 2.

FIG. 4 is a partial front view of a shirt structure, showing the collar of the shirt, with the collar stays illustrated in dashed lines.

DETAILED DESCRIPTION

Figure 5:
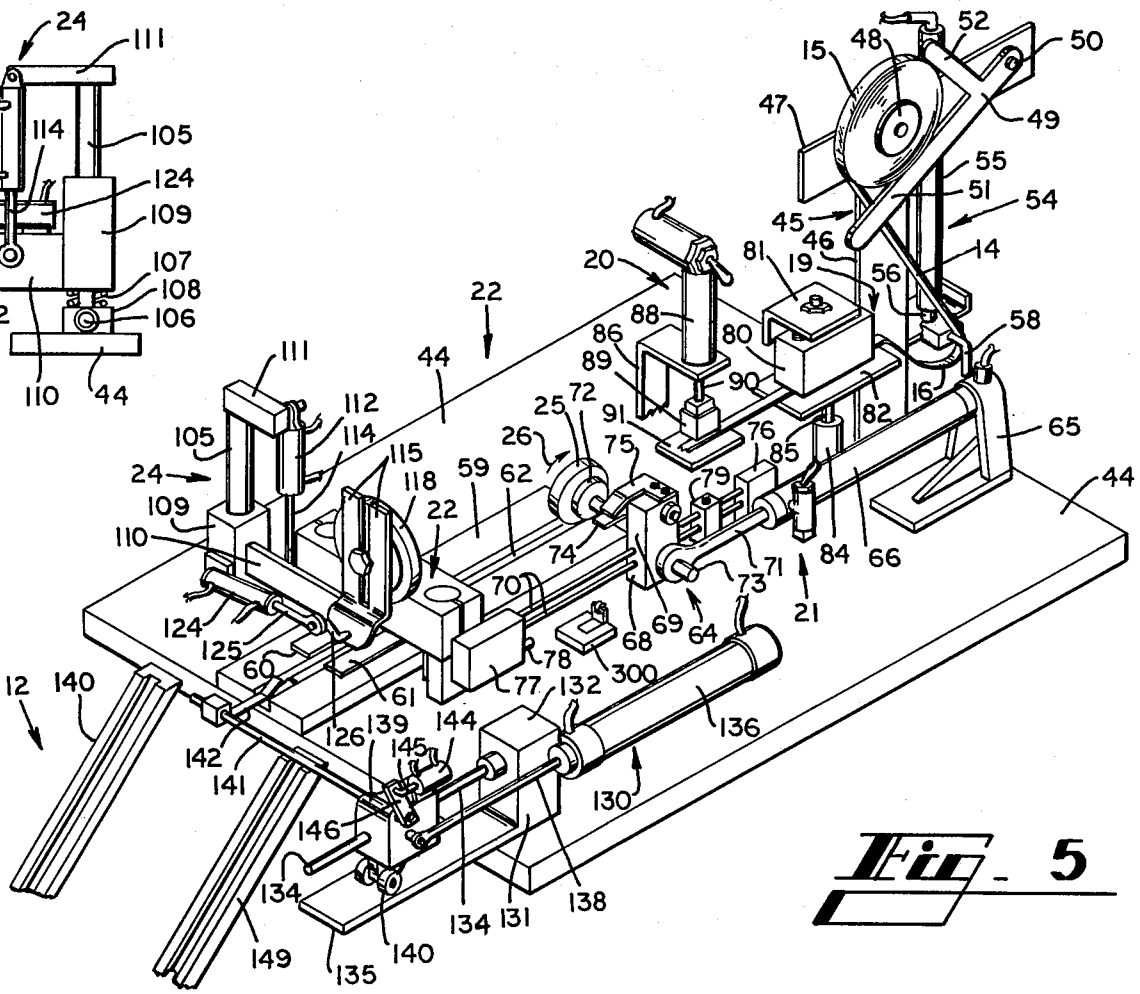
FIG. 5 is a perspective illustration of the collar stay cutting means.

Referring now in more detail to the drawings, in which like numerals indicate like parts throughout the several views, FIG. 1 schematically illustrates the post form stay inserter for shirt collars 10 which includes collar stay cutting means 11 and collar stay loading means 12. As schematically illustrated, an elongated length or strip of collar stay material 14 is fed from a supply such as reel 15 through a downward loop 16 and then along a rectilinear path 18. Positioned in sequence along the path are an iron or heating means 19, a clamp or brake 20, an indexing means 21, a cutting means 22, and an adhesive applicator 24. The indexing means 21 comprises wheel element 25 that rotates only in one direction as indicated by arrow 26 and is reciprocated as indicated by double-headed arrows 28, so that the wheel member tends to intermittently pull the strip material 14 through the path 18 through the heating means 19 and clamp 20 and push the strip on into the cutting means 22. Clamp 20 engages the strip 14 as the indexing means 21 moves in the reverse direction so as to hold the strip in position while heating means 19 and cutting means 22 are actuated to heat and cut the strip into segments such as segment 29. The adhesive applicator means 24 also applies a spot of adhesive 30 to the segment 29.

The segments 29 are then moved by the collar stay loading means 12 (FIG. 8) to the template elements 31 and 32, first by moving a collar stay 29 to the position indicated at **29*a*, then by moving a second collar stay to the position indicated at 29*b*, whereupon both collar stays 29*a* and 29*b* are reoriented to positions indicated at 29*c* and 29*d*, and then moved onto the relatively flat template elements 31 and 32 until their pointed ends overlie the pointed end portions of the template elements. The worker then inserts a partially completed collar structure 34 about the template elements 31 and 32, presses the collar material against the spots of adhesive 30 so as to cause the collar stays to adhere to the material of the collar, and then removes the collar with the collar stays properly positioned therein from the template structure and passes the collar to another work station where the top stitching 35 (FIG. 2) is formed in the collar 34 in the usual manner by a sewing machine which is schematically represented by the sewing machine needle 36. The collar stays 29 are located deep in the points of the collar structure and the top stitching 35 passes through both the collar material and the collar stays to anchor the stays in their proper locations within the collar structure. As illustrated in FIG. 3, the collar is formed from the two outer plies of material 38 and 39, the liner 40 and the collar stay 29**. In addition, a quarter patch (not shown) can be part of the collar structure.

When the final collar structure is attached to a shirt 41 (FIG. 4) the collar stays 29 are slightly bowed so as to form the collar in a convex configuration where the points 42 of the collar tend to rest upon the front of the shirt structure. The spots of adhesive applied to the collar stays together with the top stitching through the collar structure firmly anchor the collar stays in their positions within the collar structure.

As illustrated in FIG. 5, the collar stay cutting means 22 comprises a work table 44 which supports the various elements of the cutting means. The reel 15 of collar stay material is mounted on a hanger structure 45 which includes an upright stanchion 46, upper cross arm 47 and rotatable spindle 48. Stabilizer arm 49 is pivotally attached to cross arm 47 by means of pivot pin 50. Reel stabilizer 49 includes guide arm 51 and stabilizer arm 52. When the reel 15 of collar stay material is mounted on spindle 48, the free end of the material 14 is fed in a downward direction through the loop 16 and then in an upward direction onto the work table 44. The arrangement is such that the curl imparted into the material 14 by having been placed on a reel 15 faces downwardly.

Loop generator 54 is also mounted on reel support structure 45 and comprises vertically oriented loop generator cylinder 55 which has its rod 56 movable from its lower end and with loop bracket 58 mounted on the end of rod 56. When loop generator cylinder 55 is actuated to distend its rod 56, the bracket 58 moves downwardly into the bight of loop 16 to cause the material 14 to pay out from the reel and to extend the loop 16.

Plate 59 is mounted on work table 44, and a pair of spaced apart elongated rectilinear straps 60 and 61 are placed on plate 59. The space between the straps 60 and 61 form a slot 62, and the strip of material 14 feeding from reel 15 passes through the slot. Thus, slot 62 forms the rectinlinear path of movement of the material across work table 44.

Indexing means 21 comprises first indexer 64 mounted on work table 44 and includes cylinder mounting bracket 65 which is attached to the surface of the work table, first index cylinder 66, carriage assembly 68, and index wheel 25. Carriage assembly 68 includes carriage block 69 slidably mounted on a pair of parallel carriage rods 70. The rod 71 of first index cylinder 66 is attached to carriage block 69 and functions to reciprocate the carriage block 69 along the carriage rods 70. Index wheel 25 includes a clutch element 72 which is attached thereto and permits the index wheel to rotate in the direction indicated by arrow 26, while prohibiting rotation in the opposite direction. Index wheel 25 is supported by a lever 74 which is pivotally mounted to carriage block 69. Leaf spring 75 is mounted on the top of carriage block 69 and continuously urges lever 74 in a downward direction, thereby pressing index wheel 25 into the slot 62. The parallel carriage rods 70 are mounted at their ends in blocks 76 (only one shown), and valve 77 is located adjacent one end of the rods 70 with its actuator 78 in the path of the protrusion 73 from carriage block 69 so as to limit the movement of the carriage block 69 and to become actuated by the movement of the carriage block protrusion against the valve actuator 78. The movement of the carriage block 69 in the other direction is limited by the position of lock block 79 which is releasably attached to the parallel carriage rods 70 by a set screw (not shown) so that the lock block can be positioned at various locations along the length of the rods 70 to limit the reverse movement of the carriage block 69. With this arrangement the length of the strip of material being cut by the system can be varied.

Heating means 19 is located along the path of movement of the strip 14 of material and includes heating element 80 supported above the path of movement of the strip of material by bracket 81 and platen 82 positioned beneath the path of the strip of material. Presser cylinder 84 is located below platen 82 and its rods 85 is attached to the platen 82 and reciprocates the platen toward and away from heating element 80. Thus, heating means 19 functions to intermittently heat the length of the strip 14 moved along the path across the work table 44 as the presser cylinder 84 intermittently lifts the platen 82 up against pressing relationship with the strip 14 and heating element 80.

Clamp means 20 is located between heating means 19 and indexing means 21 and comprises support bracket 86 which supports clamp cylinder 88 above the path of movement of the strip 14. Brake shoe 89 is mounted on the lower end of the cylinder rod 90, and platform 91 is located below shoe 89. The strip of material 14 passes between shoe 89 and platform 91. When the cylinder 88 is actuated, the brake shoe 89 moves downwardly into engagement with the strip 14 which causes the movement of the strip 14 along its path 62 to stop.

Figure 6:
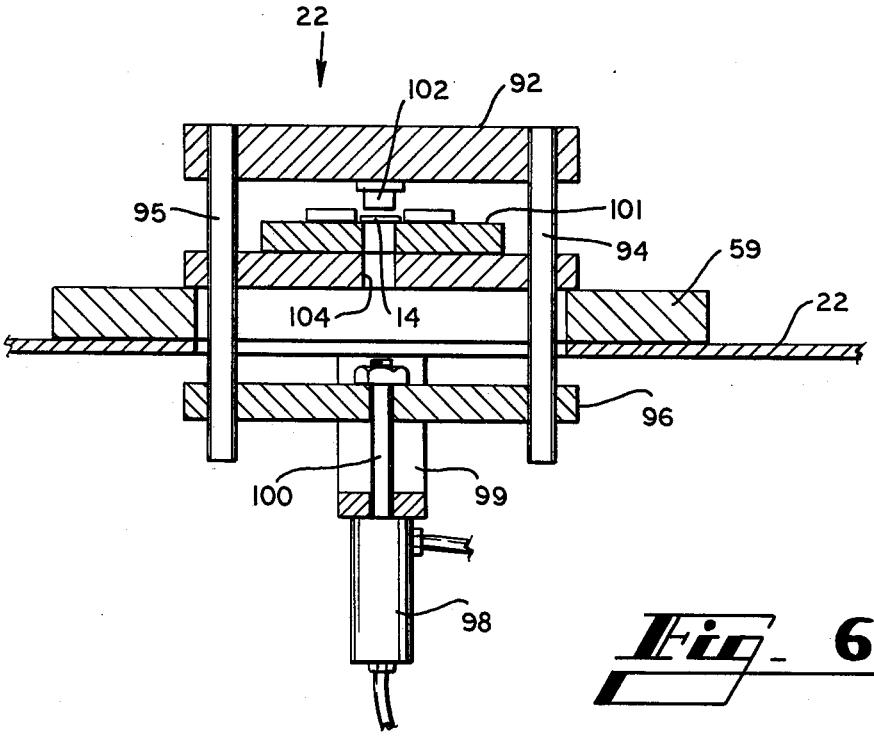
FIG. 6 is an end cross sectional view of the cutting means of FIG. 5.

Cutting means 22 is located adjacent the end of the stroke of indexing means 21 and includes a die block or cross head 92 (FIGS. 5 and 6) attached to the upper ends of shafts 94 and 95. Bottom cross head 96 is located beneath the work table 22 and is attached to the lower ends of the shafts 94, 95. Anvil cylinder 98 is attached by means of bracket 99 to the bottom surface of work table 22 and its rod 100 is connected to bottom cross head 96. Anvil 101 is located beneath dye block 92, and cutter 102 is attached to and movable with dye block 92. When cylinder 98 retracts its cylinder rod 100, the bottom and top cross heads 96 and 92 and the shafts 94 and 95 move downwardly so that the cutter 102 cuts the strip 14, with the waste of the strip passing downwardly through the opening 104.

Figure 7:
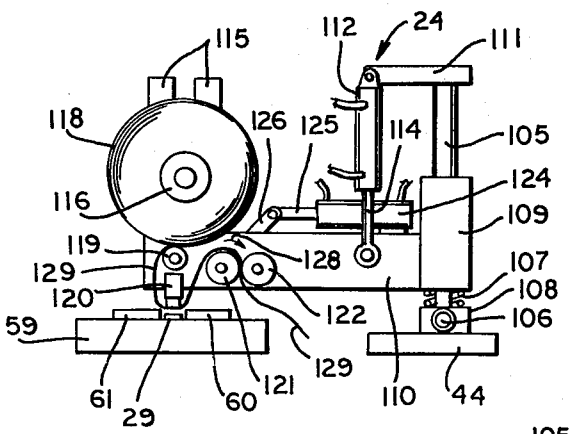
FIG. 7 is an end view of the adhesive applicator means of FIG. 5.

As illustrated in FIGS. 5 and 7, adhesive applicator means 24 comprises support shaft 105 which is pivotally mounted to work table 44 by pivot pin 106 and bracket 108, support block 109 which defines a vertical opening therethrough (not shown) which slidably receives support shaft 105, support arm 110 that is mounted to support block 109 and extends laterally therefrom, cross head 111 which is mounted to the upper end of support shaft 105, and dispenser cylinder 112 which is suspended from cross head 111. The cylinder rod 114 is connected to support arm 110 and functions to reciprocate support arm 110 and support block 109 vertically along the length of support shaft 105.

Reel mounting fork 115 extends vertically from support arm 110, and spindle 116 is slidably held in reel mounting fork 115. Adhesive transfer tape 118 is mounted on spindle 116. Support roller 119 is rotatably mounted on support arm 110 the reel of adhesive transfer tape 118 rests on the support roller. Stamp block 120 is rigidly mounted to support arm 110 and is positioned below support roller 119. Feed roller 121 and idler roller 122 are rotatably mounted on support arm 110. Crank cylinder 124 is mounted on support arm 110, and its cylinder rod 125 is connected to crank 126. The other end of crank 126 is connected to feed roller 121. Crank 126 and feed roller 121 are constructed so that oscillation of crank 126 functions to rotate feed roller 121 only in the direction indicated by arrow 128. A free end 129 of the adhesive transfer tape 118 passes downwardly about support roller 119, then about the stamp block 120, then upwardly over feed roller 121 and then downwardly between the feed roller and the idler roller 122. When cylinder 112 is actuated, its rod 114 distends which moves support block 109 and support arm 110 downwardly against the bias of spring 107 so that stamp block 120 presses the tape against a collar stay segment 29 which has been previously cut by the collar stay cutting means 22. When cylinder 114 is actuated, its rod 125 turns crank 126 and feed roller 121 so as to pull the tape from reel 118 about the stamp block 120 to position a fresh length of tape over the collar stay 29. The adhesive transfer tape is the type tape to which adhesive adheres to, but when the tape is pressed against another surface to which the adhesive will more readily adhere to, the adhesive separates from the tape and clings to the other surface. An example of a suitable adhesive transfer tape is Y-909, 1½ mil by 3M Company.

Second indexing means 130 is mounted on work table 44 and includes carriage assembly 131 which comprises support block 132, horizontal carriage bar 134 and platform 135. Second index cylinder 136 is mounted on support block 132 and its cylinder rod 138 is connected at its distal end to carriage block 139. Carriage block 139 is movably mounted on carriage bar 134 and reciprocates on rod 134 under the influence of the reciprocal movement of cylinder rod 138. A trolley 140 is mounted on carriage block 139 and rolls along platform 135. Trolley 140 tends to stabilize carriage block 139 as it reciprocates.

Spring finger rod 141 is rotatably received at one of its end in carriage block 139, and spring finger 142 is rigidly mounted at one of its ends to the other end of spring finger rod 141. Finger clamp cylinder 144 is mounted on carriage block 139 and its cylinder rod 145 is connected to one end of crank arm 146. Crank arm 146 is connected at its other end to spring finger rod 141.

When second index cylinder 136 reciprocates carriage block 139, spring finger 142 is moved toward and away from the end of the slot 62, and when finger clamp cylinder 144 is reciprocated, spring finger 142 oscillates toward and away from the slot 62. With this arrangement, the spring finger 142 will be moved over the slot, the spring finger pivoted down into engagement with a collar stay in the slot, and then the spring finger will be moved laterally away from the slot, dragging a collar stay with it. After the collar stay has cleared the slot 62, the spring finger 142 will be pivoted up so that it is ready for its next cycle. The bottom surface of slot 62 adjacent the end of the slot is sloped downwardly at **62*a* so that the spring finger 142 is effective in wiping the collar stays 29** from the slot.

Figure 8:
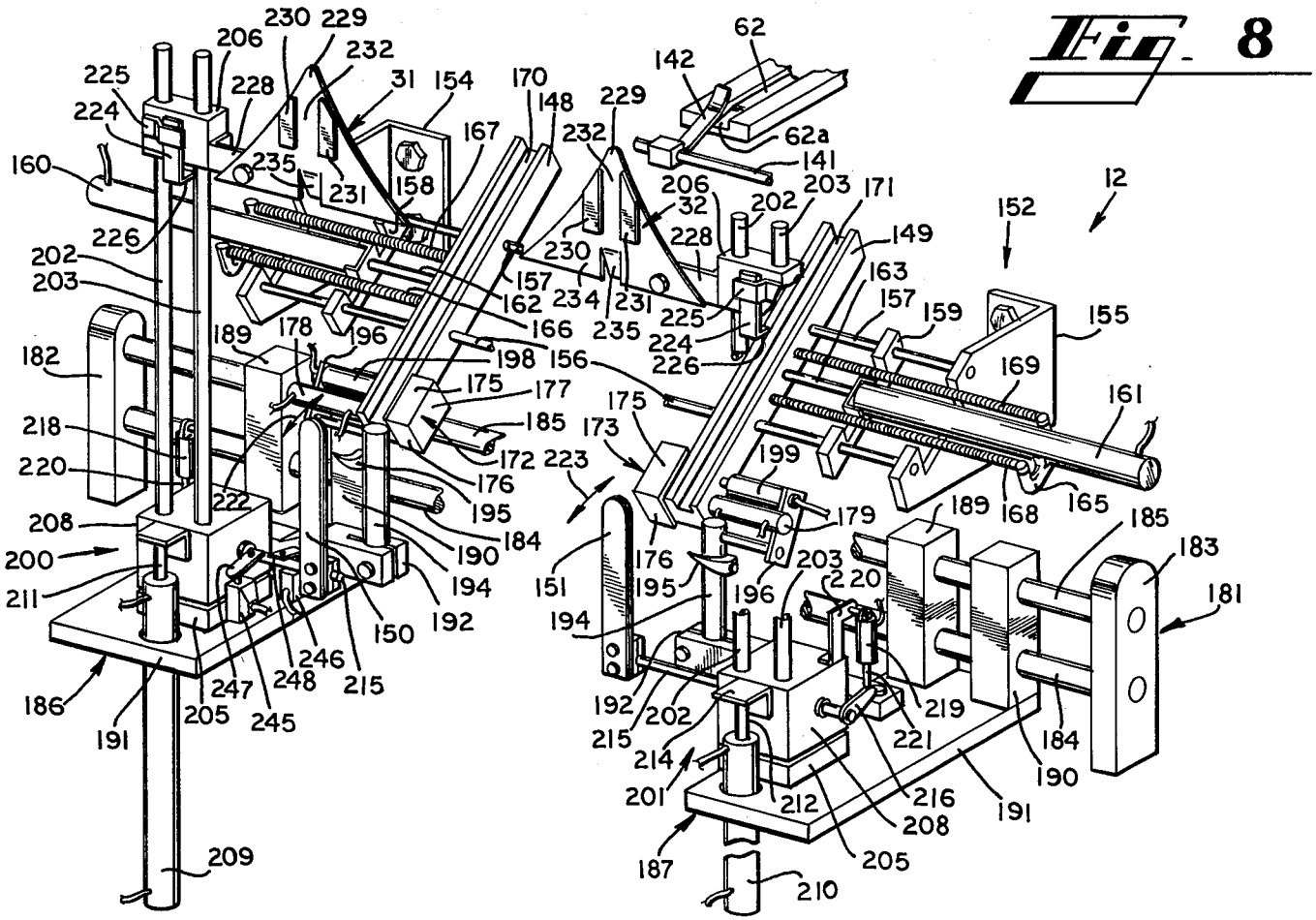
FIG. 8 is a perspective illustration of the collar stay loading means.

As best illustrated in FIG. 8, the collar stay loading means 12 is located at the end of work table 44 (FIG. 5) and generally comprises movable loading chutes 148 and 149, pairs of grasping fingers 150 and 151 and collar templates 31 and 32.

Loading chute support assembly 152 comprises a pair of support brackets 154 and 155 mounted to a common support (not shown) and a pair of parallel guide bars 156 and 157 extending horizontally between and supported at their ends by the support brackets 154 and 155. Loading chutes 148 and 149 are slidably mounted on guide bars 156 and 157, by the insertion of the guide bars through openings in the loading chutes. In this manner, loading chutes 148 and 149 are maintained in parallel, side-by-side relationship, and both are movably along the lengths of the guide bars 156 and 157. Cylinder support brackets 158 and 159 are also mounted on guide bars 156 and 157 by the insertion of the guide bars through openings in the cylinder support brackets. Chute cylinders 160 and 161 are supported by cylinder support brackets 158 and 159, and cylinder rods 162 and 163 bear against movable loading chutes 148 and 149. Spring support forks 164 and 165 are mounted on support brackets 154 and 155, and coil tension springs 166, 167, 168 and 169 are connected at their ends to movable loading chutes 148 and 149 and to spring support forks 164 and 165. The springs 166–169 tend to urge the movable loading chutes toward the sides of the assembly while the cylinders 160 and 161 operate to urge the movable loading chutes toward the center of the assembly.

Figure 9:
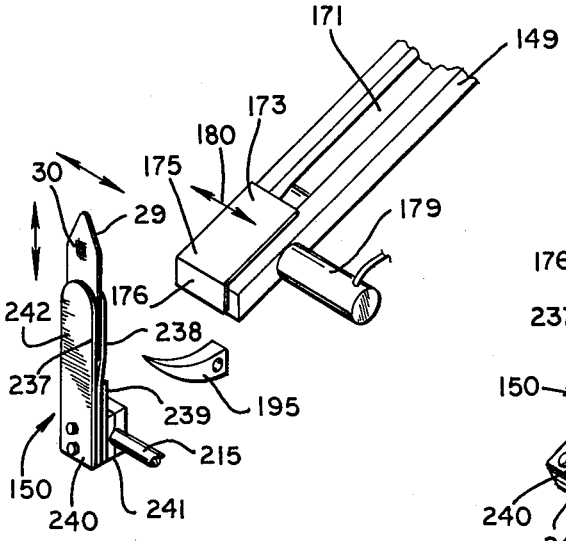
FIGS. 9 and 10 are progressive illustrations of a loading chute and the collar stay gripping fingers.
Figure 10:
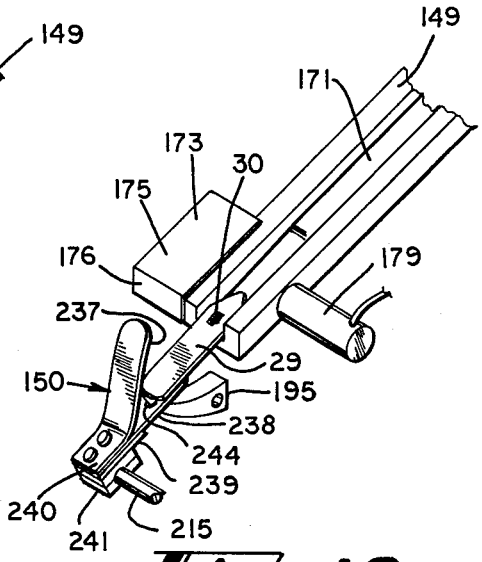

Each movable loading chute 148 and 149 is inclined and defines a slot 170 and 171, respectively, with the slot of each loading chute extending entirely along its length. A stop bracket 172, 173 is located at the lower end of each loading chute 148 and 149, respectively. Each stop bracket includes a top wall 175, an end wall 176, and a side wall 177. Each stop bracket is open at its upper end and at one of its sides and is movable laterally over the lower end of its loading chute. Stay stop cylinders 178 and 179 are mounted on the lower ends of chutes 148 and 149 respectively and their cylinder rods (not shown) are connected to the stop brackets 172 and 173 and operate to reciprocate the stop brackets 172 and 173 over the lower ends of chutes 148 and 149. As illustrated in FIGS. 9 and 10, the stop bracket 173 of loading chute 149 reciprocates in the direction indicated by arrows 180 between positions where the stop bracket covers the lower end of the slot 171 (FIG. 9) and where the stop bracket uncovers the lower end of the slot.

Finger and template support carriage 181 is mounted beneath loading chute support assembly 152 and includes end support blocks 182 and 183, a pair of carriage bars 184 and 185 which are mounted at their ends and maintained in parallel relationship by the end support blocks, and a pair of carriage structures 186 and 187. Each carriage structure 186 and 187 includes a pair of carriage blocks 189 and 190 which are slidably received on carriage bars 184 and 185 and a carriage platform 191 attached to the bottoms of the carriage blocks 189 and 190. The carriage platforms 191 are therefore movable toward and away from each other by sliding the carriage blocks 189 and 190 along the lengths of carriage bars 184 and 185.

Each carriage platform 191 has mounted thereon a stanchion support 192 and an upright stanchion 194. The stanchion support is bolted at one of its ends to platform 191 and the other end is bifurcated to receive the lower end of the stanchion 194. Finger opening pin 195 is mounted on stanchion 194 and valve support bracket 196 is mounted to the upper end of the stanchion. Chute valves 198 and 199 are each mounted on valve support brackets 196 and have their valve actuator buttons facing the movable chutes 148 and 149. When the movable chutes 148 and 149 are moved by their springs 166–169 toward the outside of the assembly, the movable chutes will engage the actuators of valves 198 and 199.

The carriage platform 191 at each side of the assembly also carries grasping finger carriage assembly 200 and 201. Each grasping finger carriage assembly includes a pair of upright carriage bars 202 and 203 which are mounted at their lower ends in support block 205. The upper ends of the carriage bars are connected together by stabilizer block 206. Carriage block 208 is mounted on the carriage bars 202 and 203 and is movably vertically along the length of the carriage bars. Carriage block cylinders 209 and 210 are each mounted to a carriage platform 191, and their cylinder rods 211 and 212 are connected to the carriage blocks 208 by a bracket 214. Thus, when cylinders 209 and 210 are actuated, the carriage blocks 208 will move vertically along the lengths of carriage bars 202 and 203.

A finger support rod 215 is pivotally mounted at one of its ends and each carriage block 208, and the pairs of grasping fingers 150 and 151 are rigidly connected at one of their ends to the finger support rod 215. Crank arm 216 is connected to finger support rod, and finger pivot cylinders 218 and 219 are mounted on the carriage blocks 208 by means of support bracket 220, and the cylinder rod 221 is connected to the crank arm 216. Thus, when cylinder 219 is actuated, crank 216 will be oscillated to oscillate finger support rod 215 and stay grasping fingers 150 and 151, causing the fingers to oscillate in the manner indicated by arrows 222 and 223.

The stabilizer blocks 206 at the upper ends of carriage bars 202 and 203 are supported by and stabilize the upper ends of the carriage bars. Stroke limiter brackets 224 are detachably mounted on stabilizer blocks 206. A leaf spring 225 is bolted to the stabilizer block 206 and its free end clamps the upper end of the stroke limiter bracket 224 to the stabilizer block. The lower end of the stroke limiter bracket is turned inwardly at 226, so that when a carriage block 208 is moved upwardly under the influence of its carriage block cylinder 209 or 210, the carriage block will engage the stroke limiter bracket 224, which limits the distance through which the carriage block and its grasping fingers 150 and 151 can move. If it is desired to change the distance of travel of the fingers 150 and 151, a longer or shorter stroke limiter bracket can be inserted beneath the leaf spring 225, by simply sliding the stroke limiter bracket out from beneath the leaf spring and inserting the new stroke limiter bracket having a different length in position beneath the leaf spring.

The collar template elements 31 and 32 are mounted on the stabilizer block 206, by means of a bracket 228. Each collar template element 31 and 32 is approximately triangular in shape and includes an upwardly extending pointed portion 229. A pair of spaced, parallel guide rails or ribs 230 and 231 are affixed to the flat surface of each template element and defines a slot 232 therebetween to guide the collar stays into alignment with the pointed edge portion 229. The lower edge portion 234 of each collar template element has a portion thereof 235 which is bent or struck from the flat plane of the template element so as to function as a deflector and deflect the collar stay being moved upwardly by the grasping fingers 150 or 151 and onto the template element, to assure that the collar stays do not inadvertently pass behind the collar template elements. Thus, the ribs 230 and 231 and element 235 function as guide surfaces for guiding collar stays into alignment with the upwardly extending pointed edge portion of the collar template.

As illustrated in FIGS. 9 and 10, the pairs of grasping fingers 150 and 151 each comprise resilient fingers 237 and 238 which are elongated and flat and which are placed in abutment with each other. A rigid support plate 239 is placed in abutment with grasping finger 238 and tends to rigidify the lower ends 240 of the fingers. Support block 241 connects the rigid support plate 239 to the finger support rod 215. The upper end portions 242 of the fingers 237 and 238 are bendable apart from each other. As illustrated in FIG. 10, the grasping finger 238 defines an opening therein at 244, while the grasping finger 237 does not. The opening 244 of grasping finger 238 is sized and located so that it extends over finger opening pin 195 when the grasping fingers are pivoted toward the finger opening pin. Thus, finger opening pin 195 fits through finger 238 and bears against the upper finger 237, causing the upper finger to spread apart from finger 238. When the fingers 237 and 238 are pivoted back to an upright position (FIG. 9) the upper finger 237 bends back toward its rectilinear configuration toward abutment with finger 238. In the meantime, if a collar stay 29 has moved downwardly through the slot 171 in the collar stay chute, the collar stay 29 will be allowed to move further down the inclined chute as stop bracket 173 is moved to the side, until the collar stay abuts the finger opening pin 195. When the grasping fingers 237 and 238 are then pivoted from their inclined open positions (FIG. 10) back to their upright positions (FIG. 9) a collar stay 29 will be grasped between the fingers with the pointed end of the collar stay protruding above the fingers and with the spot of adhesive 30 located beyond the fingers.

As illustrated in FIG. 8, finger-up valve 245 and finger-down valve 246 are mounted on carriage platform 191 of the left carriage structure 186. Valve actuators 247 and 248 are rigidly connected to finger support rod 215 of the left carriage structure 186 and are located so as to actuate the valves 245 and 246. When the grasping fingers 150 are upright, the actuator 247 will actuate finger-up valve 245, and when the grasping fingers 150 are pivoted down to their inclined or down positions, actuator 247 will disengage its finger-up valve while actuator 248 will engage its finger-down valve 246.

OPERATION

When the post form stay inserter for shirt collars 10 is in operation, with a pair of collar stays grasped between the grasping fingers 150 and 151 and located with the pointed portion of the collar stay in alignment with the pointed portion 229 of the collar template elements 31 and 32 and with another pair of collar stays at the bottom of the chutes 148 and 149, the operator, who is seated facing the collar template elements, inserts a collar about the template elements with the pointed portions of the collar placed about the upper pointed portions 229 of the template elements. The operator presses the material of the collar against the spots of adhesive 30 on the collar stays and then lifts the collar off the template elements. The adhesive causes the collar stays to adhere to the collar, so that the collar stays adhere to the collar in the proper positions. The collar is then passed onto a sewing station where the top stitching is formed in the collar (FIG. 2), thereby anchoring the collar stays in the collar.

Figure 11:
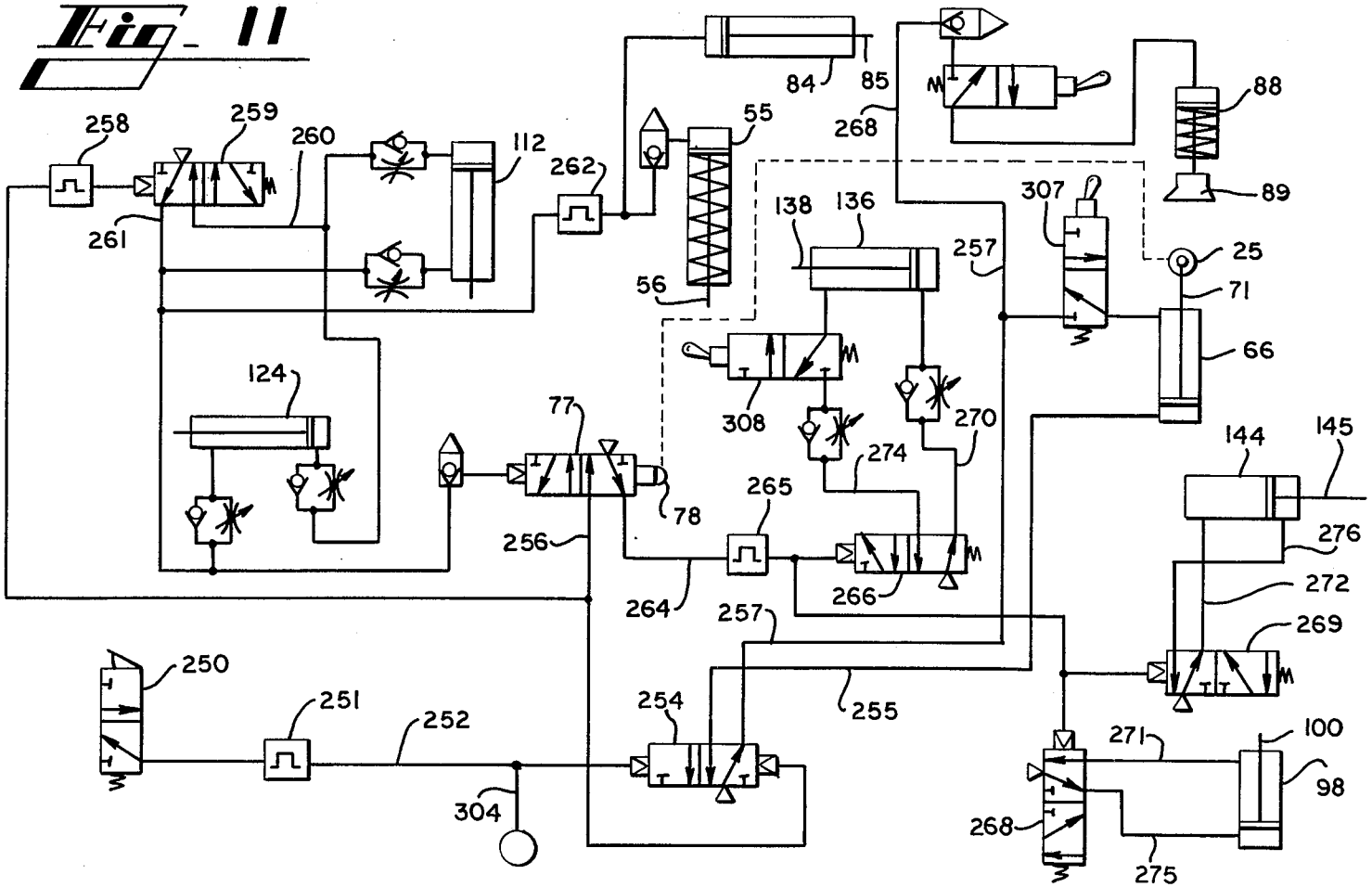
FIGS. 11 and 12 are schematic illustrations of the pneumatic control system which controls both the collar stay cutting means and the collar stay loading means.

As the worker removes the collar structure from the template elements, she presses a foot switch 250 (FIG. 11) which begins the cycle of the post form and stay inserter system 10. Foot switch 250 communicates a source of air pressure to pulse valve 251. Pulse valve 251 sends a surge of air pressure through conduit 252 to first control valve 254. Control valve 254 is shifted by the pulse of pressure so that air pressure is communicated from control valve 254 through conduit 255 to first index cylinder 66, which causes the cylinder rod 71 to distend from the cylinder the move the index wheel 25 (FIG. 5) along the slot 62 and move the strip of material 14 along the slot. When the index wheel reaches the end of its stroke, the protrusion 73 of the carriage block engages the actuator 78 of second control valve 77, thereby shifting second control valve 77. When second control valve 77 is shifted, air under pressure presses through conduit 256 to first control valve 254, to shift the first control valve back to its start position. Thus, air under pressure passes through conduit 257 from first control valve 254 to the other end of first index cylinder 66 and to holding clamp cylinder 88. This causes the first index cylinder to retract index wheel 25, so that the index wheel rolls along the strip 14 toward its home position, and causes the brake shoe 89 of clamp cylinder 88 to move down into engagement with the strip, to keep the strip from moving along its length as the index wheel 25 rolls along the strip.

In the meantime, the shifting of second control valve 77 causes air pressure to communicate with long pulse valve 258. Long pulse valve 258 causes a pulse of air pressure to be communicated to the end of third control valve 259. Third control valve 259 is spring biased to its home position so that at the end of the long pulse from valve 258, it shifts back to its home position. However, during the time in which the third control valve has been shifted by a long pulse of air pressure, air under pressure passes through the valve to conduit 260 which energizes the adhesive indexer cylinder 124 and the adhesive dispenser cylinder 112 causing a fresh length of tape to be placed beneath the adhesive applicator and the movement of the adhesive applicator in a downward direction to apply adhesive to a previously cut collar stay. After the long pulse from valve 258 has timed out, the third control valve 259 will be shifted back by its spring to its original position, whereupon air under pressure will communicate with conduit 261. Pressure in conduit 261 causes adhesive indexer cylinder 124 to retract, adhesive cylinder 112 to retract, and sends pressure to long pulse valve 262. A long pulse from valve 262 is communicated to loop generator cylinder 55 which distends its cylinder rod 56 and causes more of the strip material 14 to pay out from the reel 15. The pulse also is communicated to presser cylinder 84, causing its rod 85 to distend and press the strip material up against the heating element, to reduce the curl from the strip of material. When the pulse from valve 262 times out, the loop generator cylinder and presser cylinder will retract. In the meantime, the high pressure air from third control valve 259 also communicates with the pressure end of second control valve 77, causing the second control valve to shift back to its original position.

When second control valve has shifted back to its original position, air pressure will communicate through conduit 264 through timer 265 to one end of each of fourth control valve 266, fifth control valve 268, and sixth control valve 269. Each of the control valves 266, 268 and 269 are spring urged to their home positions, but the air pressure shifts the valves away from their home positions.

When fourth control valve 266 is shifted away from its home position, air under pressure passes through the valve to conduit 270 to second indexing cylinder 136, to distend its cylinder rod 138. This causes the spring finger 142 to begin its movement away from the slot 62 on the work table.

In the meantime, the air pressure through fifth control valve and conduit 271 actuates anvil cylinder 98, causing the cutting element 102 to cut a segment from the strip of material 14.

In the meantime, the air pressure through sixth control valve 269 passes through conduit 272 to actuate finger clamp cylinder 144, to distend its cylinder rod 145, to pivot the spring finger 142 toward engagement with the now cut collar stay in slot 62 on the work table. Thus, the second indexing cylinder 136, anvil cylinder 98 and finger clamp cylinder 144 tend to cut and move a collar stay away from the strip of material 14 on the work table 44.

After the timer 265 times out, the fourth, fifth and sixth control valves 266, 268 and 269 will be shifted by their springs back to their home positions. When the fourth control valve is thus shifted, air pressure communicates through conduit 274 to the other end of second indexing cylinder 136 to retract the second indexing cylinder. The air pressure communicates through fifth control valve 268 and conduit 275 to distend the cylinder rod 100 of the anvil cylinder 98. The air pressure communicates through sixth control valve 269 with conduit 276 to distend the cylinder rod 145 of finger clamp cylinder 144. Thus, the spring finger 142 will be returned to its raised position over the slot 62 in the work table, where it is ready to repeat its cycle of operation.

Figure 12:
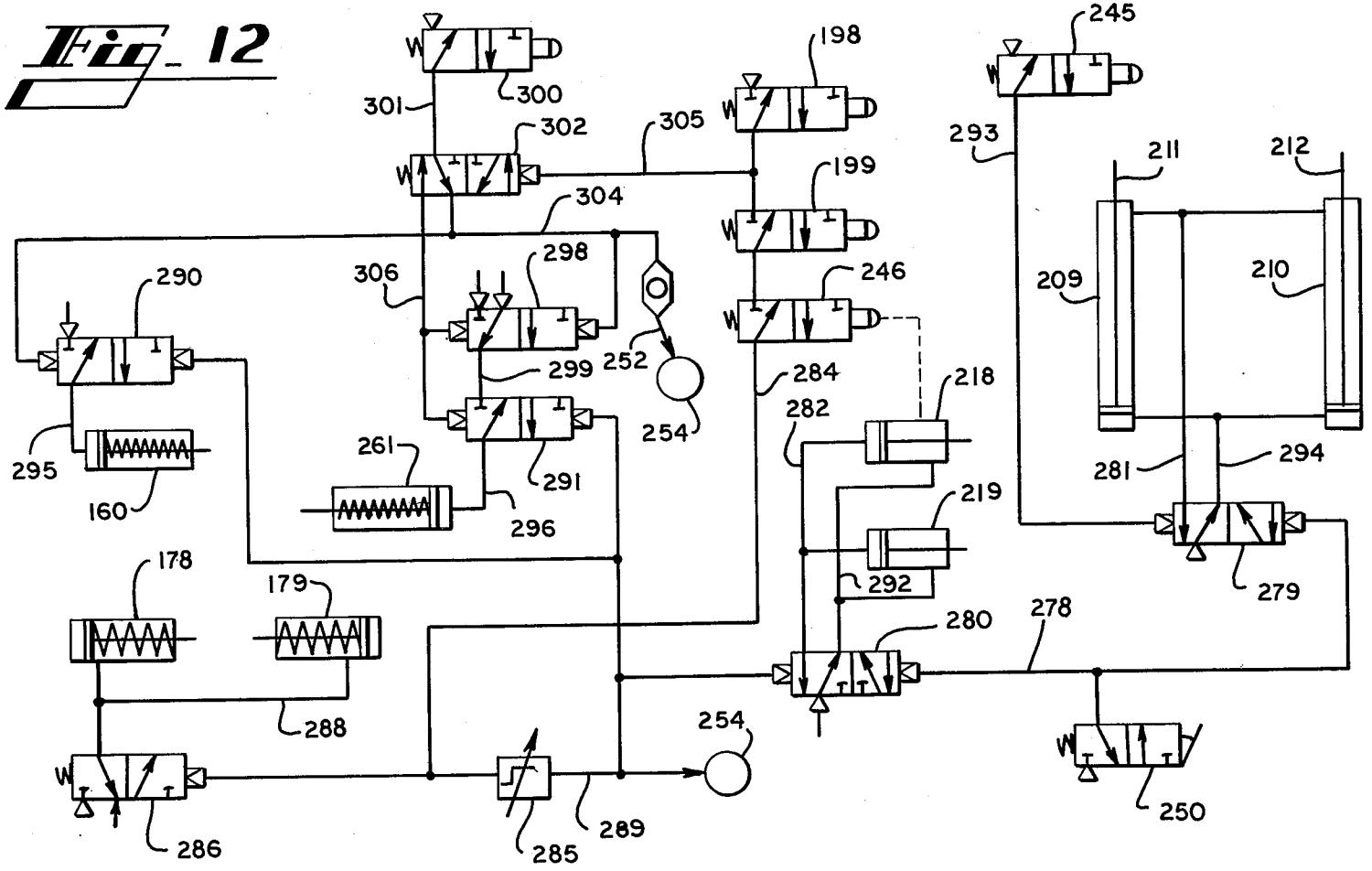

As illustrated in FIG. 12, when the operator actuates foot valve 250, the collar stay loading means 12 is also actuated. Foot valve 250 charges conduit 278 with air pressure, causing seventh and eighth control valves 279 and 280 to shift. When the system is at rest before the foot valve has been actuated, the carriage block cylinders 209 and 210 will have their cylinder rods 211 and 212 distended. When seventh control valve 279 is shifted by the foot valve 250, air pressure communicates through conduit 281 to the upper ends of cylinders 209 and 210, causing the grasping fingers to move down away from the templates. In the meantime, the shifting of eighth control valve 280 causes air pressure to communicate through conduit 282 with finger pivot cylinders 218 and 219, causing the grasping fingers to pivot from their upright attitudes (FIG. 9) to their inclined attitudes (FIG. 10). When the grasping fingers have become aligned with the collar stay chutes 148 and 149, valve actuator 248 (FIG. 8) depresses finger-down valve 246. At this point, the grasping fingers are now inclined and open at the bottoms of the inclined chutes.

Since the collar stay chutes 148 and 149 are located in their side positions, the chute valves 178 and 179 are engaged by the collar stay chutes and are therefore open. Valves 198, 199 and 246 are in series (FIG. 12), and when all the valves are open, air pressure surges through conduit 284 to on delay timer 285 and to ninth control valve 286. Ninth control valve 286 causes air pressure to move through conduit 288 to the ends of stay-stop cylinders 178 and 179, causing the stay stops 172 and 173 to move away from the lower ends of the inclined collar stay chutes, thereby releasing the collar stays from the chutes to move on down between the grasping fingers (FIG. 10). In the meantime, the on delay timer 285 times out within one second and the air pressure communicates through conduit 289 to tenth and eleventh control valves 290 and 291 and to eighth control valve 280. Thus, eighth control valve is shifted back to its start position, causing air pressure to move through conduit 292, retracting finger pivot cylinders 218 and 219 so that the grasping fingers move to an upright attitude. When the grasping fingers are rotated in this manner, the valve actuator 247 (FIG. 8) actuates finger-up valve 245 which pressurizes conduit 293, thus shifting seventh control valve 279 back to its start position, whereupon air pressure communicates through conduit 294 to distend carriage block cylinders 209 and 210, thus moving the collar stays up into overlying relationship with respect to the pointed portions of the collar templates. In the meantime, the collar stay chutes 148 and 149 are empty and the collar stay cutting means 22 has been energized by the foot switch 250 (FIG. 11) and a collar stay is on the way.

The shifting of tenth and eleventh control valves 290 and 291 causes air pressure to pass through conduits 295 to chute shifter cylinder 160 and through conduit 296 to chute shifter cylinder 161. The air passing through eleventh control valve 291 must first pass through air pressure control valve 298, and one source of air pressure through valve 298 is at eighty pounds per square inch while the other source of air pressure through the valve is at ten pounds per square inch. When the system is in the condition described, the air passing from air pressure control valve 298 through conduit 299 through eleventh control valve 291 and conduit 296 to chute shifter 161 is at ten pounds per square inch. The inclined collar stay chutes 148 and 149 are moved toward each other by cylinders 160 and 161 until they abut each other. Since line pressure at eighty pounds per square inch is applied to chute shifter cylinder 160 and only ten pounds per square inch air pressure is applied to chute shifter cylinder 161, the left collar stay chute 148 will push the right collar stay chute 149 out of the way so that the left collar stay chute 148 becomes aligned with the slot 62 of the cutting means. Thus, the first collar stay is moved by the spring finger 142 into the left collar stay chute 148.

When the first indexer 21 on the work table 44 begins to move back to its start position so as to be able to feed another segment of strip material 14 to the collar stay cutting means 22, the protrusion 73 of the carriage block 29 passes over the one way valve 300 which is actuated only by the reverse direction of movement of the index wheel. When valve 300 is actuated, a surge of air pressure communicates through conduit 301 through twelvth control valve 302 to conduit 304. A pulse of air pressure is then passes back to first control valve 254 (of FIG. 11), to air pressure control valve 298 and to tenth control valve 290. The first control valve 254 again begins the sequence of operation of the collar stay cutting means 22, the air pressure control valve 298 shifts so that the high pressure air communicates through conduit 299 with chute shifter cylinder 161, and tenth control valve 290 is shifted so that the air pressure through conduit 295 is blocked and the spring of the chute shifter cylinder 160 (FIG. 8) returns the cylinder rod to its home position and the coil tension springs 166 and 167 bring the collar stay chute 148 back to its side position where it actuates chute valve 198. Chute valve 198 sends air pressure through conduit 305 to shift twelfth control valve 302 against the bias of its spring. In the meantime, the high pressure communicated from air pressure control valve 298 through conduit 299, eleventh control valve 291 and conduit 296 to chute shifter cylinder 161 causes the right collar stay chute 149 to be urged by high pressure air to the center position at alignment with slot 62. Thus, when the spring finger 142 of the collar stay cutting means 22 delivers another collar stay, the right chute 149 will be in alignment with the path of the collar stays so as to receive the collar stay.

After the second delivery of a collar stay the indexing means again momentarily depresses the one way valve 300. This sends a surge of air pressure through conduit 301, through the shifted twelfth control valve 302, through conduit 306 to shift air pressure control valve 298 and eleventh control valve 291 back to their home positions. Thus, low pressure air communicates from air pressure control valve with eleventh control valve 291, but since eleventh control valve 291 has shifted, the air pressure will no longer communicate with chute shifter cylinder 161 and its coil tension springs 168 and 169 will pull the right collar stay chute 149 back to its side position. When the right collar stay chute reaches its side position it actuates its chute valve 199.

When the collar stay loading means 12 is in this condition, collar stays are present in the grasping fingers 150 and 151 and are located in overlying relationship with the upper pointed ends of the templates 31 and 32, and collars stays are located in the lower ends of the collar stay chutes 148 and 149. Thus, a complete cycle of the system has taken place and the system is ready for its next cycle.

The control system also includes toggle valves located in some of the conduits so that the air pressure to some of the elements of the system can be cut off by the operator when desired. For example, toggle switches 307 and 308 are placed in conduits 268 and 274 to selectively control first indexing cylinder 66 and second indexing cylinder 138.

While this invention has been described in detail with particular reference to preferred embodiments thereof, it will be understood that variations and modifications can be effected within the spirit and scope of the invention as described hereinbefore and as defined in the appended claims.

We claim:

1. A method of inserting collar stays into collars comprising the steps of moving a pair of collar stays with pointed ends extending in their directions of movement along the surface of a collar template until the pointed ends of the collar stays are in registration with the pointed portions of the collar template, inserting a partially completed collar about the template, simultaneously pressing the collar against both of the collar stays and removing the collar with the collar stays inside the collar from the template.

2. The method of claim 1 and further including the step of holding the collar stays at their ends opposite to their pointed ends to maintain the collar stays in juxtaposition with the surface of the collar template and with the pointed ends in registration with the pointed portions of the collar template.

3. A method of inserting collar stays into partially completed collars comprising placing a first collar stay into a first loading chute, moving the first loading chute laterally until it is in alignment with a first pointed portion of a collar template, placing a second collar stay into a second loading chute, moving the second loading chute laterally until it is in alignment with a second pointed portion of the collar template, moving the collar stays from the first and second loading chutes onto the collar template until the end portions of the collar stays are in overlying relationship with the pointed portions of the collar template, inserting a partially completed collar about the collar template, and removing the collar with the collar stays therein from the collar template.

4. A collar template structure comprising a pair of flat collar template elements each including a pointed edge portion shaped to receive the pointed ends of a partially completed collar structure and guide means for guiding a collar stay into alignment with the pointed edge portions, support means for holding said flat template elements in side-by-side relationship and in a common inclined plane and for moving said flat template elements toward or away from each other, so that the pointed edge portions of the templates can be spaced from each other a distance corresponding to the distance between the pointed ends of the partially completed collars to be inserted thereon, and means for moving collar stays along said guide means to a position where one end of each collar stay is in overlying relationship with a pointed edge portion of a flat collar template.

5. The collar template structure of claim 4 and wherein said guide surface comprises a deflector extending from the collar template elements.

6. The collar template structure of claim 4 and wherein said guide surface comprises a pair of ribs mounted on each of said collar templates in spaced relationship for guiding a collar stay along the surface of the template into alignment with the pointed edge portions of the template.

* * * * *